US005680887A

United States Patent [19]

Brand

[11] Patent Number: 5,680,887

[45] Date of Patent: Oct. 28, 1997

[54] VENEER SLICER WITH TIMING BELT

[75] Inventor: Robert D. Brand, Lawrence, Ind.

[73] Assignee: Capital Machine Co., Inc., Indianapolis, Ind.

[21] Appl. No.: 565,423

[22] Filed: Nov. 30, 1995

[51] Int. Cl.[6] ..... B27C 1/00

[52] U.S. Cl. ..... 144/178; 144/162.1; 144/214

[58] Field of Search ..... 144/178, 162.1, 144/211, 212, 213 A, 213 R, 214; 74/44

[56] References Cited

U.S. PATENT DOCUMENTS

| | | | |
|---|---|---|---|
| 793,306 | 6/1905 | Koss . | |
| 2,576,520 | 11/1951 | Koss | 144/178 |
| 2,676,627 | 4/1954 | McFall | 144/178 |
| 2,937,536 | 5/1960 | Clement | 74/44 |
| 3,441,069 | 4/1969 | Koss | 144/369 |
| 3,654,973 | 4/1972 | Koss | 144/178 |
| 3,680,612 | 8/1972 | Hale | 144/178 |
| 3,750,725 | 8/1973 | Cremona | 144/178 |
| 3,808,925 | 5/1974 | Hards | 83/346 |
| 3,841,468 | 10/1974 | Eggert | 74/44 |
| 3,905,408 | 9/1975 | Hale | 144/178 |
| 4,068,693 | 1/1978 | Cremona | 144/178 |
| 4,069,850 | 1/1978 | Cremona | 144/178 |
| 4,392,519 | 7/1983 | Calvert | 144/212 |
| 4,503,721 | 3/1985 | Hietanen et al. | 74/44 |
| 4,503,896 | 3/1985 | Brand | 144/369 |
| 4,587,616 | 5/1986 | Weil | 364/475 |
| 4,601,317 | 7/1986 | Brand | 144/178 |
| 4,683,926 | 8/1987 | Weil | 144/178 |
| 5,101,874 | 4/1992 | Weil | 144/209 |
| 5,143,129 | 9/1992 | Toivio | 144/211 |
| 5,150,746 | 9/1992 | Weil | 144/209 |
| 5,333,658 | 8/1994 | Albion et al. | 144/213 |
| 5,385,184 | 1/1995 | Mellor | 144/178 |

FOREIGN PATENT DOCUMENTS

0627285A2 12/1991 European Pat. Off. .

OTHER PUBLICATIONS

*Double Dogging Flitch System*, Sales Brochure of Capital Machine Co., Inc.

*Primary Examiner*—W. Donald Bray
*Assistant Examiner*—Gene L. Kim
*Attorney, Agent, or Firm*—Brinks Hofer Gilson & Lione

[57] ABSTRACT

A veneer slicer includes a flitch drive assembly for reciprocating a flitch table. The drive assembly includes a timing belt coupling a drive motor output shaft to at least one driven wheel, wherein the driven wheel is connected to the flitch table by a connecting rod and the flitch table reciprocates in response to rotation of the driven wheel. The drive assembly can include a plurality of driven wheels and a single timing belt coupling the plurality of driven wheels to the output shaft. Alternatively, each driven wheel can be coupled to a drive shaft by a separate timing belt.

16 Claims, 6 Drawing Sheets

VENEER SLICER WITH TIMING BELT

The present invention relates to veneer slicers and particularly to veneer slicers with reciprocating flitch tables. More particularly, the invention relates to drive systems for reciprocating the flitch table.

BACKGROUND OF THE INVENTION

Reciprocating flitch tables are well known in the veneer slicing art. In conventional reciprocating flitch tables, a drive motor is coupled to a pair of driven wheels. Connecting rods connect the driven wheels to the flitch table so that rotation of the driven wheel reciprocates the flitch table. The drive motor typically drives a central gear that directly drives the driven wheels. The driven wheels, which are essentially large gears, are usually, although not necessarily, driven by the central gear so as to rotate in the same direction, as illustrated in FIG. 2.

This conventional gearing system is generally adequate to the task of reciprocating a flitch table and has been in use for many years. See, for example, U.S. Pat. No. 793,306 to Koss, U.S. Pat. No. 2,576,520 to Koss, U.S. Pat. No. 2,676,627 to McFall, and U.S. Pat. No. 4,601,317 to Brand (particularly FIG. 2).

Gears, however, wear with use creating clearances between the gear surfaces. The reciprocation of the flitch table necessarily causes the flitch table to come to a stop and reverse its direction of travel at the top and bottom of its movement. When the flitch table reverses direction, backlash occurs between the driven wheels and the drive gear. At the normal operating speeds of conventional flitch tables, the backlash produces an objectionable noise level.

As is also known in the veneer slicing industry, flitches fall off the flitch table from time to time. When the flitch falls off, it sometimes becomes wedged between the flitch table and the factory floor, interfering with the full movement of the flitch table. If the slicer is not stopped in time, such interference can cause severe damage to the slicer such as damaged bearings, bent shafts, or stripped gears, resulting in costly repairs as well as the lost productivity due to down time for the slicer.

SUMMARY OF THE INVENTION

The present invention solves those problems in conventional slicers by reducing the operating noise level of the slicer in the event that a flitch falls off of the flitch table. The present invention includes a flexible timing belt to couple the output shaft of the drive motor to the driven wheels, thereby eliminating backlash between the drive gear and the driven wheels and providing a damage absorbing member in the drive assembly that can preferentially absorb potential damage and be replaced relatively inexpensively and easily.

According to the present invention, a veneer slicer comprises a slicing blade, a reciprocating flitch table for retaining a flitch for slicing, a carriage for moving the slicing blade between a cutting position and a retracted position relative to the flitch, a flitch support assembly for supporting the flitch table, and a flitch drive assembly for reciprocating the flitch table. The drive assembly includes a timing belt coupling a drive motor output shaft to at least one driven wheel, wherein the driven wheel is connected to the flitch table by a connecting rod and the flitch table reciprocates in response to rotation of the driven wheel.

In one embodiment of the invention, the drive assembly includes a plurality of driven wheels and the timing belt couples the plurality of driven wheels to the output shaft. In a second embodiment of the invention, the drive assembly includes a plurality of driven wheels and each driven wheel is coupled to a drive shaft by a separate timing belt. The drive shaft is further coupled to the output shaft. In the second embodiment, a plurality of timing belt engaging portions are arranged axially along the drive shaft and a plurality of intermediate wheels are aligned with the timing belt engaging portions so that one of the timing belts couples one of the timing belt engaging portions to an intermediate wheel.

The drive assembly of the second embodiment further includes a plurality of intermediate wheels coupled to intermediate shafts, the intermediate shafts being coupled to the driven wheels to rotate the driven wheels and thereby move the flitch table.

In preferred embodiments of the invention, each driven wheel includes a load arm extending radially outwardly from the axis of rotation of the driven wheel, for a rotatable attachment to a connecting rod, and a counterbalance portion disposed generally opposite the load arm. A closure can be included that defines an interior region, with the drive assembly being disposed within the interior region.

Additional features and advantages of the invention will become apparent to those skilled in the art upon consideration of the following detailed description of a preferred embodiment exemplifying the best mode of carrying out the invention as presently perceived.

DETAILED DESCRIPTION OF THE DRAWINGS

Figure 1:
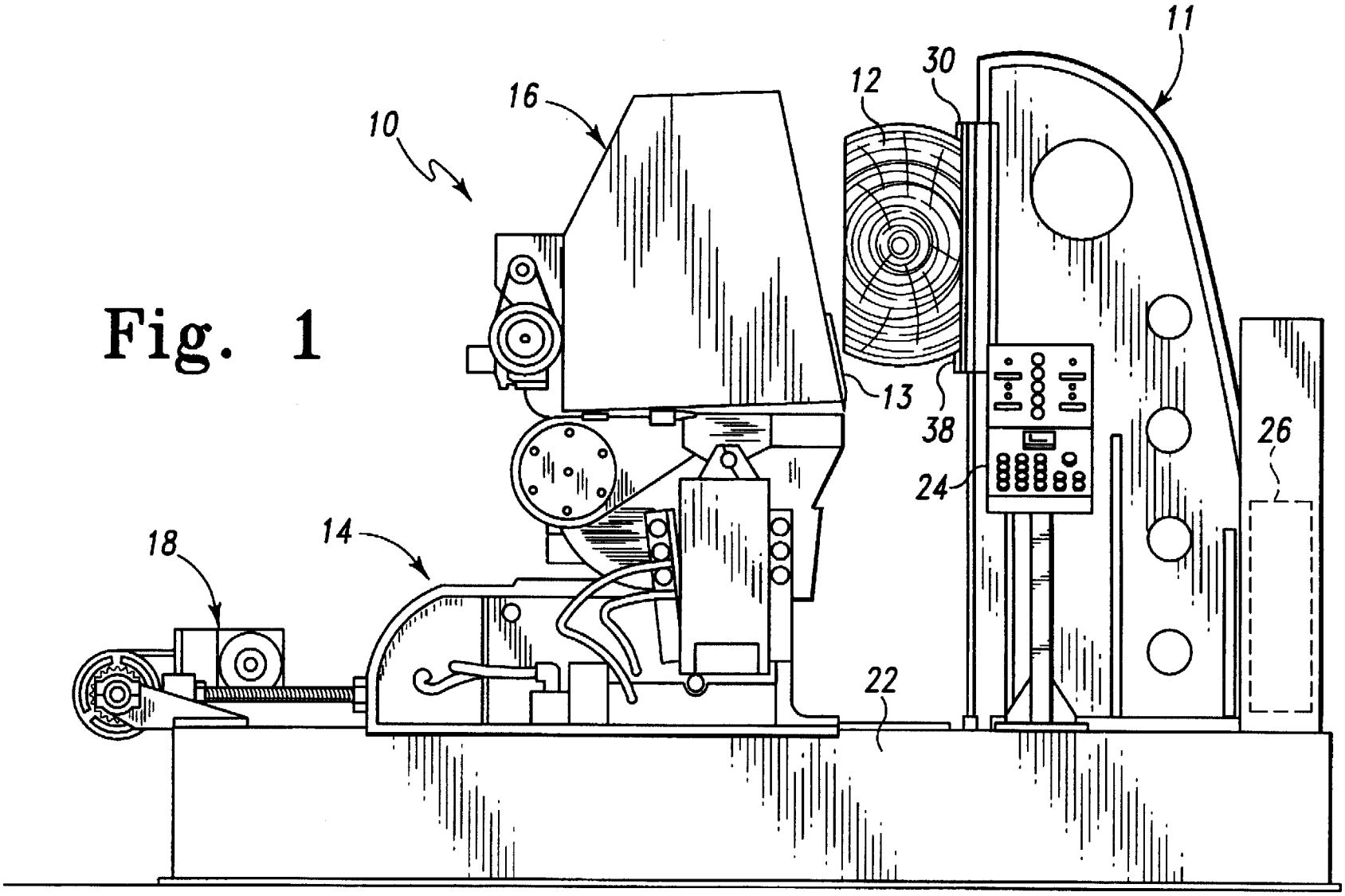
FIG. 1 is a side view of a reciprocating veneer slicer for use with the present invention.

A veneer slicer that can incorporate the present invention is illustrated in FIG. 1. The veneer slicer comprises a veneer slicing machine 10 which includes a support assembly 11 for supporting a log or log section 12, referred to as a flitch, for reciprocation and slicing by a cutting blade 13. The flitch is carried by a flitch table 30, which is vertically movable relative to a cutting blade 13 and in the apparatus illustrated and described herein, is reciprocated such that thin veneer sheets can be sliced from the flitch 12 during each upward stroke of the flitch 12. If desired, the system can also be designed to slice veneer sheets from the flitch 12 during each downward stroke of the flitch 12.

Machine 10 also includes a carriage 14 which supports a pressure plate and cutting blade assembly 16. Carriage 14 is horizontally movable toward and away from the flitch support assembly 11 during the operation of the machine.

The carriage 14 can position the cutting blade 13 adjacent to the flitch 12 to slice a veneer sheet from the flitch during the upward or slicing stroke of the flitch support assembly 11 and move the cutting blade 13 away from the flitch 12 during the downward or return stroke of the flitch 12. A carriage drive means 18 is provided for moving the carriage 14.

Figure 2:
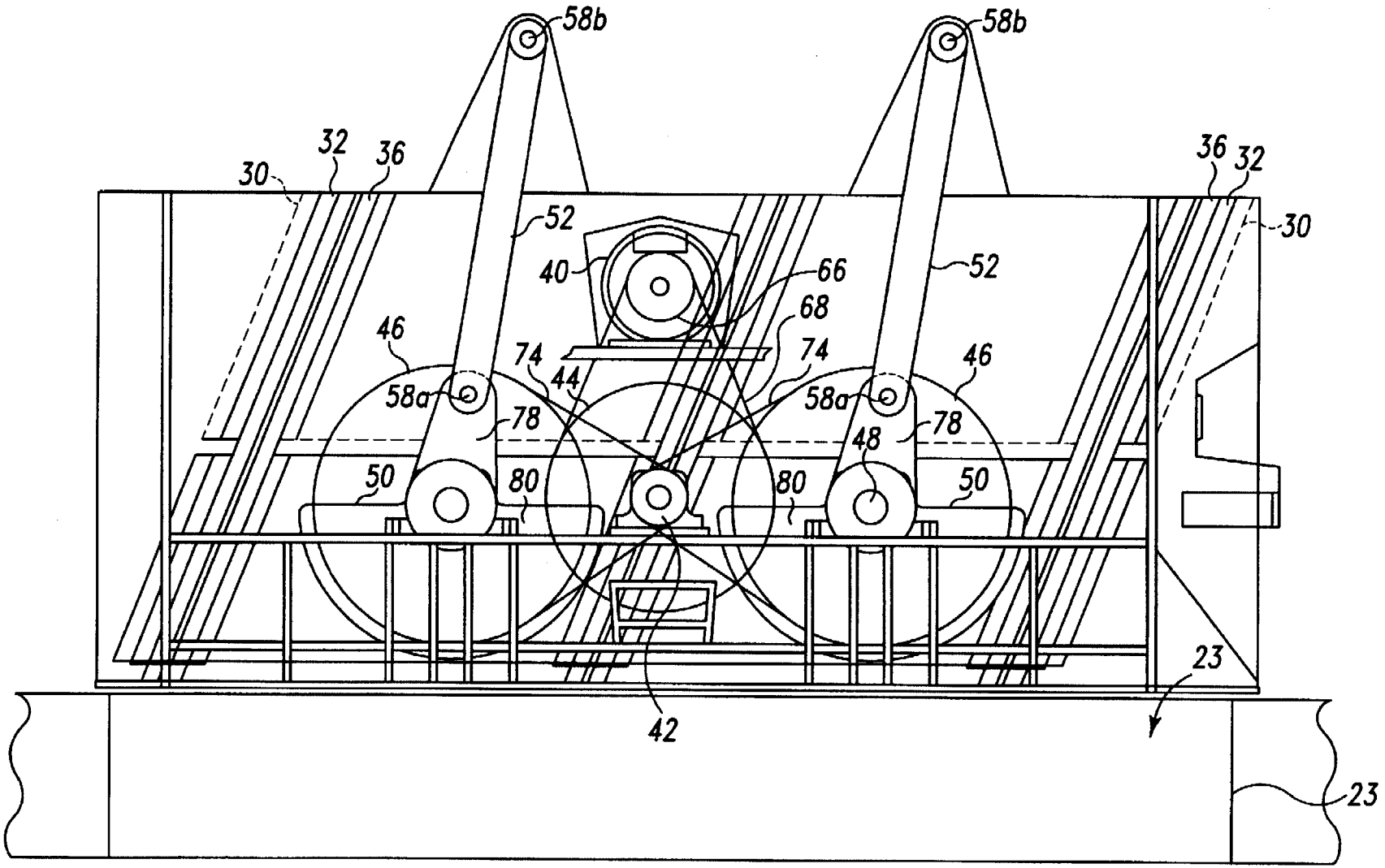
FIG. 2 is a diagrammatic view of a flitch support assembly drive means according to the present invention.
Figure 3:
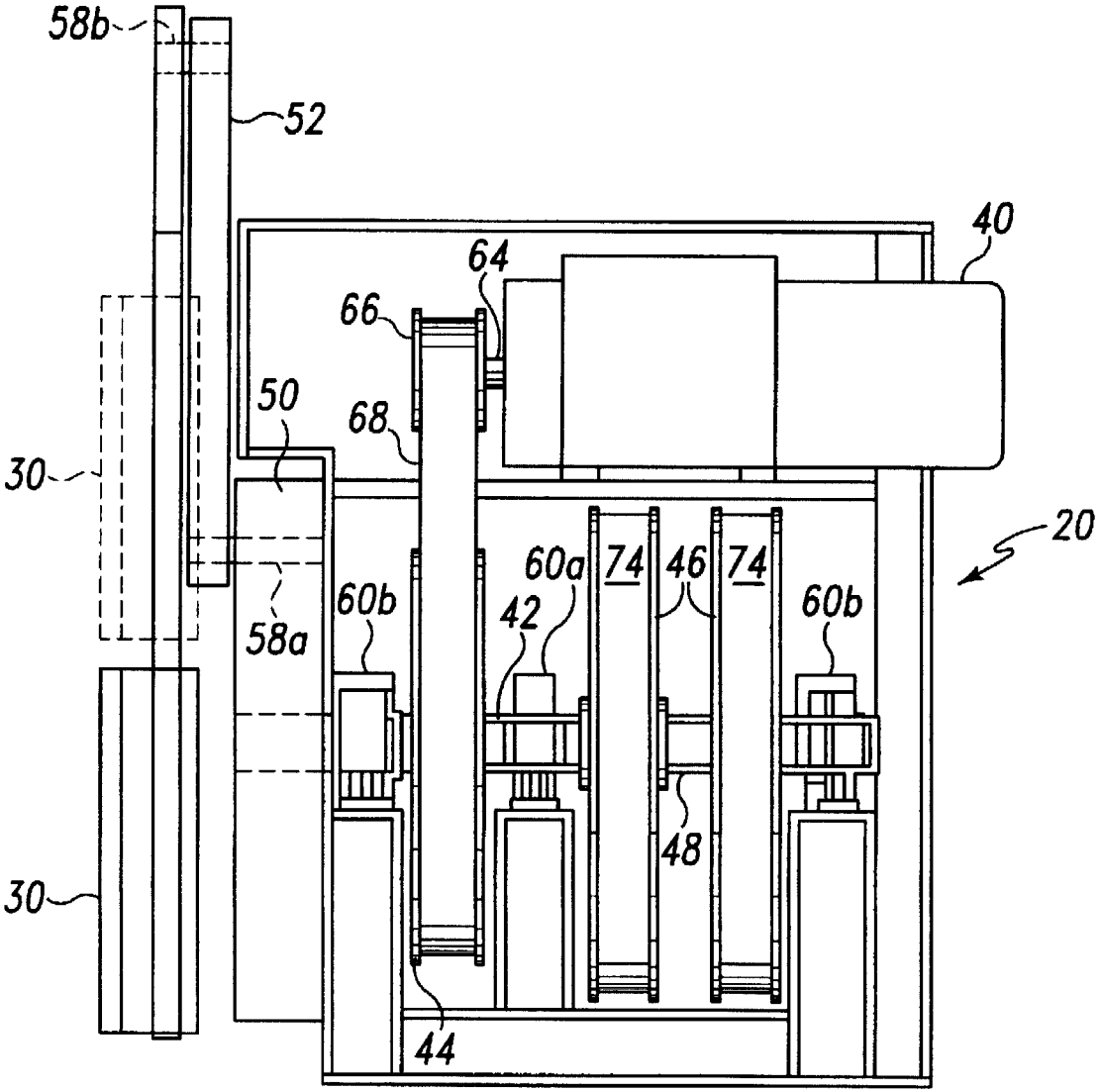
FIG. 3 is a diagrammatic side view of the flitch support assembly drive means of FIG. 2.

A flitch support drive means 20 (FIGS. 2–4) is provided for reciprocating the flitch 12. Flitch support assembly 11, carriage 14, and the drive means 18, 20 are all supported on a massive frame 22 which is preferably embedded within the floor of the factory. Preferably, flitch-receiving pit 23 is formed in the factory floor and positioned in front of the flitch table 30 to catch flitches that fall off of the flitch table 30 and thereby keep the flitches from interfering with the movement of the slicer. A control console 24 and an electrical control cabinet 26 are electrically coupled to the machine to control and monitor the operation of the machine. Also included in the machine, but not illustrated, is a sheet transport assembly for receiving the veneer sheets sliced from the flitch and for transferring the sheets to a location to be picked up and stacked by an operator for removal from the area.

Flitch support assembly 11 includes the flitch table 30 supported on a plurality of inclined guides 32 (FIGS. 2 and 5) for reciprocating vertical movement along the guides. Guides 32 are supported by suitable standards 36. The flitch 12 is firmly mounted to the flitch table 30 by a plurality of dogs 38 (FIG. 1) or by vacuum (not shown) as is well known in the art. The flitch table 30 is illustrated at a lower position in solid lines and at an upper position in dotted lines in FIGS. 2, 3, 5 and 6.

In the invention, one or more timing belts are combined with elements of the flitch support drive means 20 to provide smooth, quiet reciprocation of a flitch with a reduced possibility for breakage of elements of the veneer slicer.

Figure 4:
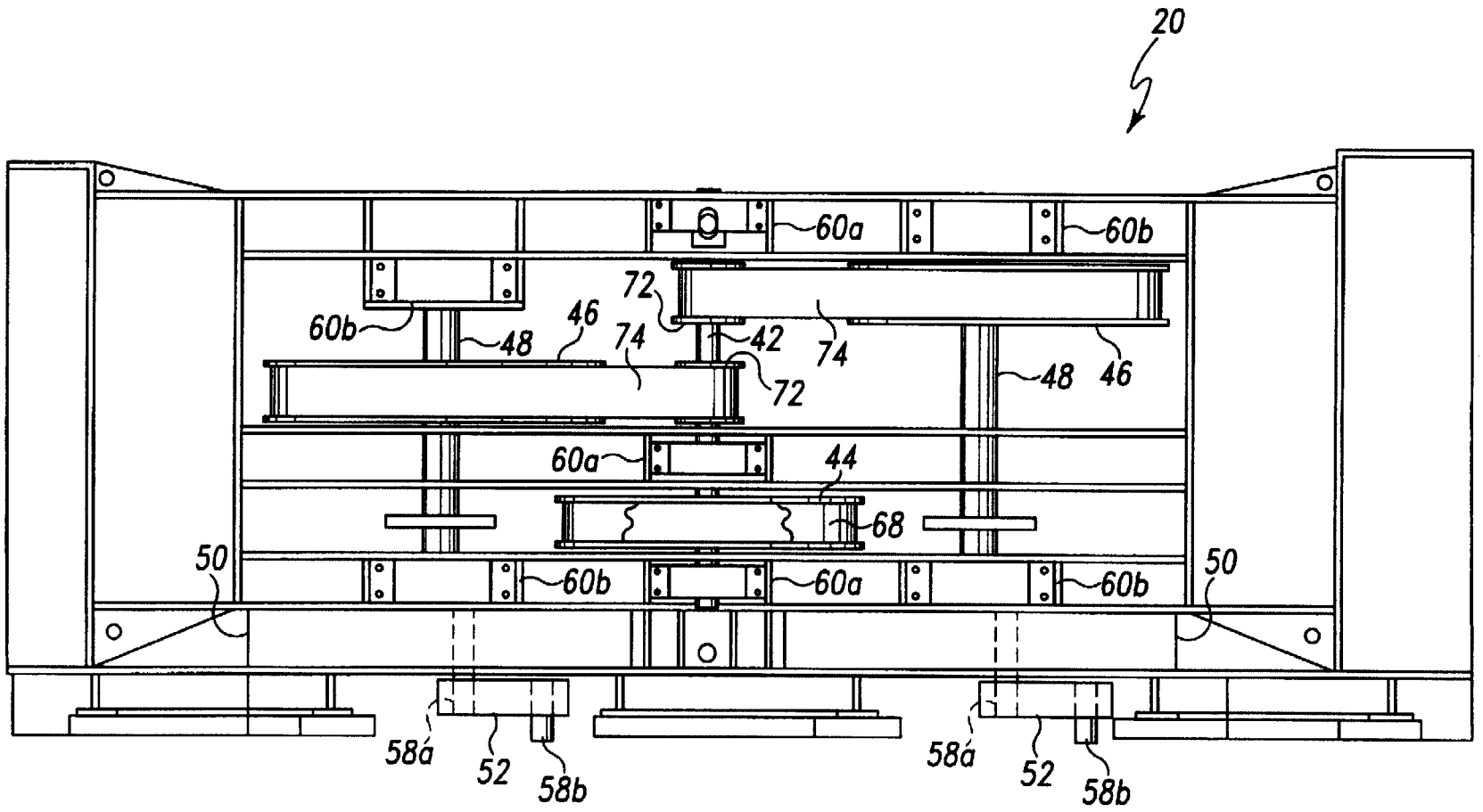
FIG. 4 is a diagrammatic top view of the flitch support assembly drive means of FIG. 2 with the flitch table, the drive motor and its output wheel omitted for the sake of clarity.

Flitch support drive means 20 includes a flitch drive motor 40, a drive shaft 42, a drive wheel or sheave 44 coupled to a drive shaft 42, and a pair of intermediate wheels 46 coupled to driven wheels 50 by intermediate shafts 48. An output shaft 64 of the drive motor 40 is coupled to an output wheel or sheave 66. The drive motor 40 is coupled to the drive sheave 44 by a V-belt 68 that engages the output sheave 66. As shown in FIG. 4, the drive shaft 42 is coupled to the intermediate wheels 46 by timing belts 74 that engage belt engaging portions 72 of the drive shaft 42, which may be provided by timing belt sheaves coupled to the drive shaft 42. In any event, the peripheries of belt engaging portions 72 and intermediate wheels 42 are configured to engage the timing belt without slippage.

The intermediate wheels 46, through their coupling to intermediate shafts 48 drive the driven wheels 50. Pivot pins **58*a*, 58*b* rotatably couple connecting rods 52 to the driven wheels 50 and to the flitch table 30, respectively. Conventional bearings 60*a*, 60*b* support the drive shaft 42 and the intermediate shafts 48, respectively. The position of the connecting rods 52 in FIGS. 2 and 3 correspond to the dotted line position of the flitch table 30** shown therein.

The drive motor 40 is preferably of the type which runs continuously and is coupled to the flitch table by an eddy current clutch (not shown) that varies speed by varying the amount of slippage. For example, a preferred motor is manufactured by DYNAMIC CORP. as Model No. AS-440-11. As shown in FIG. 4, the drive motor 40 is disposed above the drive shaft 42 and positioned so as to align the output sheave 66 with the drive sheave 44. The output sheave 66 and the drive sheave 44 are both configured to receive a continuous V-belt 68.

The drive shaft 42 is positioned between, and in the same plane as, the intermediate shafts 48, each of which include a pair of timing belt-engaging portions 72. The intermediate wheels 46 are displaced from each other axially, relative to the drive shaft 42, and each is aligned with a timing belt-engaging portion 72. Timing belt 74 extends partially around and engages each timing belt-engaging portion 72 and its respective intermediate wheel 46. A preferred timing belt is of the type manufactured by DODGE/RELIANCE ELECTRIC as Model No. 5000-20M-170, PT #142309.

Each intermediate wheel 46 is coupled to an intermediate shaft 48 which is further coupled to a driven wheel 50. The driven wheels 50 include a load arm 78 extending radially outwardly from the center of the driven wheel 50 and a counterbalance portion 80 that is disposed generally opposite the load arm 78. The load arm 78 is rotatably coupled to one end of a connecting rod 52 by a pivot pin **58*a*. The other end of the connecting rod 52 is rotatably coupled to the flitch table 30 by a pivot pin 58*b***.

Engagement of the rotational output of the motor shaft 64 through an eddy current clutch (not shown) or directly coupled to a DC motor rotates the output sheave 66, which in turn rotates drive wheel 44 by V-belt 68. Drive shaft 42 is rotated through its coupling to drive wheel 44, and thereby drives belt engaging portions 72, timing belts 74 and intermediate wheels 46. The resulting driven rotation of intermediate wheels 46 drives shafts 48 and driver wheels 50, resulting in reciprocation of the flitch table 30.

Figure 5:
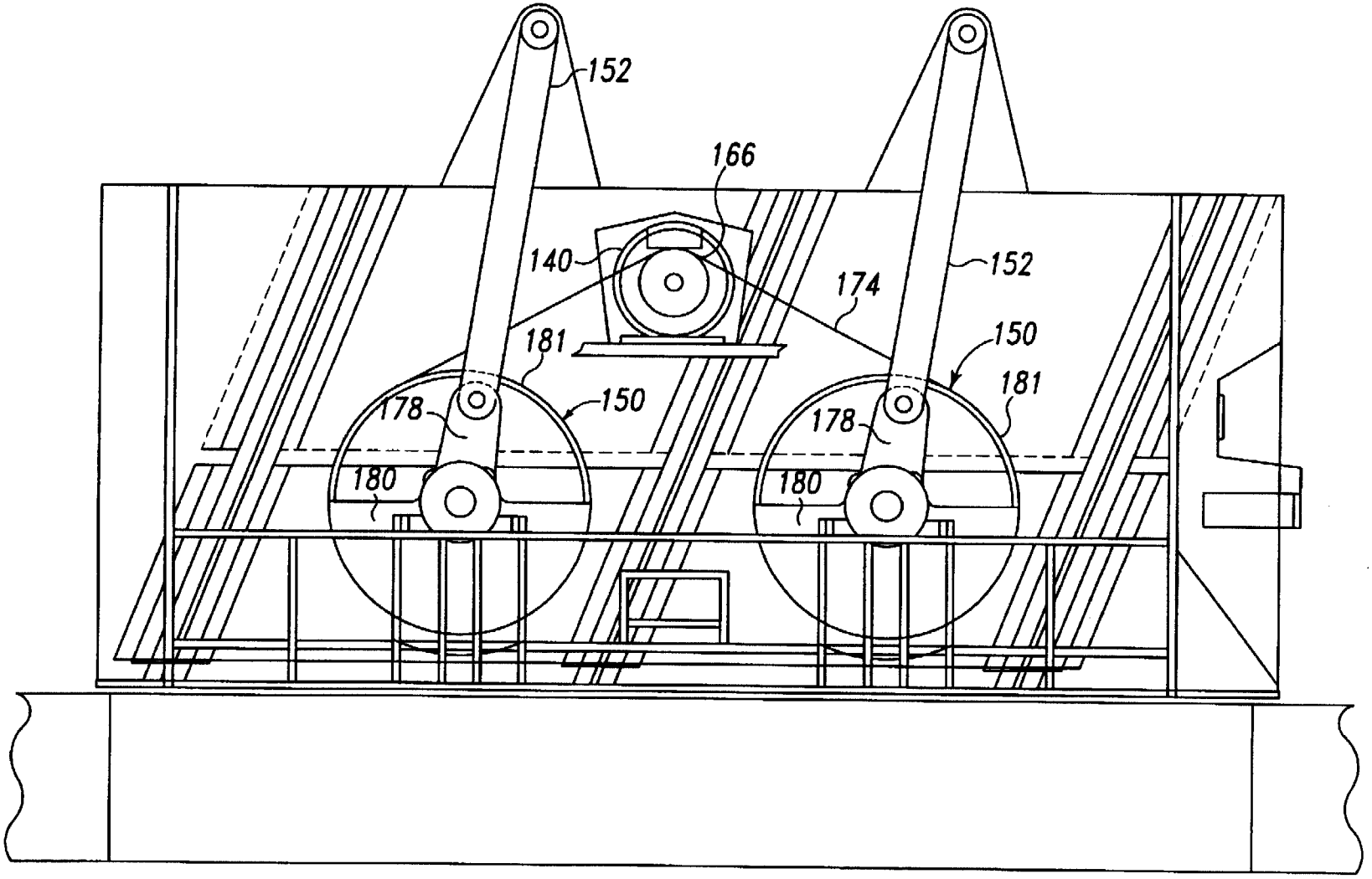
FIG. 5 is a diagrammatic front view of an alternative embodiment of the flitch support assembly drive means.
Figure 7:
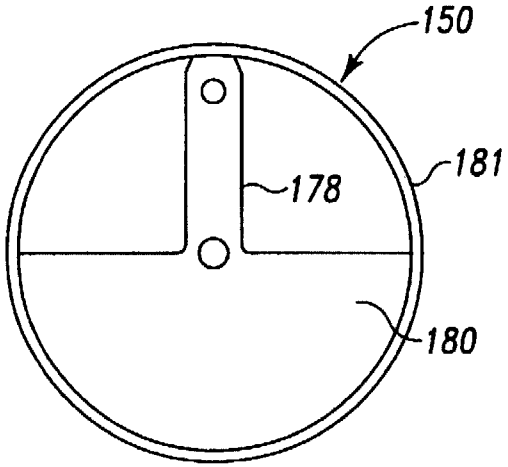
FIG. 7 illustrates a driven wheel for use with the drive means of FIGS. 5 and 6.
Figure 6:
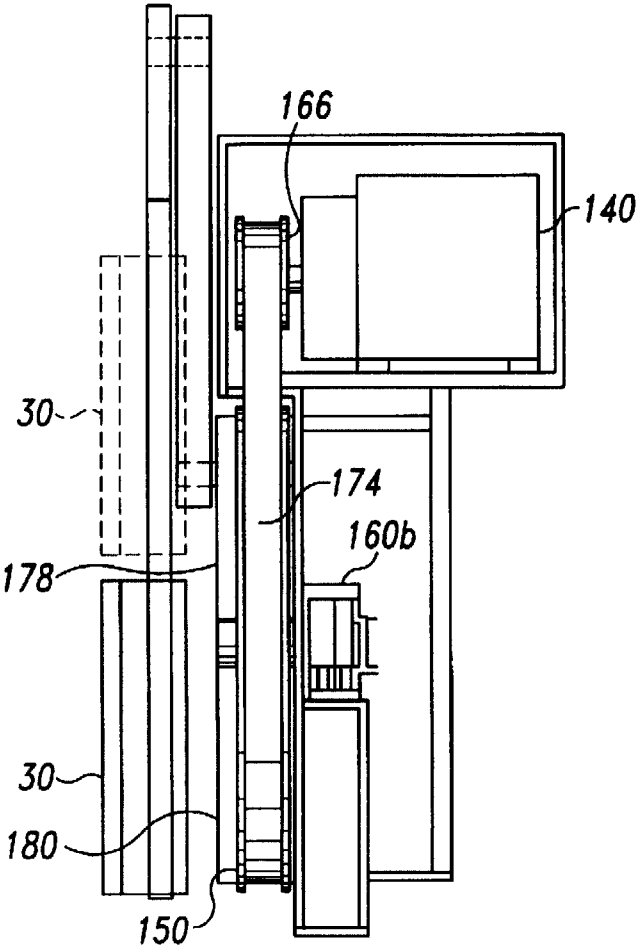
FIG. 6 is a diagrammatic side view of the flitch support assembly drive means of FIG. 5.

In an alternative embodiment of the invention, as illustrated in FIGS. 5 and 6, the output wheel 166 can be coupled directly to the driven wheels 150 by a timing belt 174, without any intermediate shafts or intermediate wheels. As shown, the motor 140 can be positioned to align the output wheel 166 with the driven wheels 150. As shown in FIG. 7, in the alternative embodiment, the driven wheel 150 would include a load arm 178 for rotatably connecting the driven wheel 150 to a connecting rod 152, a counterbalance portion 180 disposed generally opposite the load arm 178, and a circumferential ring portion 181 surrounding the load arm 178 and the counterbalance portion 180. The ring portion 181 is configured at its periphery to engage the timing belt 174.

Although the invention has been described in detail with reference to particular embodiments, variations and modifications exist within the scope and spirit of the invention as described and defined in the following claims.

I claim:

1. A reciprocating flitch table comprising:

a plurality of guides configured to guide the reciprocating movement of the flitch table;

a plurality of connecting rods, each connecting rod having a first end rotatably coupled to the flitch table;

a plurality of driven wheels, each driven wheel being coupled to one of a plurality of intermediate shafts for rotation therewith and to a second end of one of the plurality of connecting rods, said connecting rods reciprocating the flitch table in response to rotation of the driven wheels;

a plurality of intermediate wheels, each intermediate wheel being coupled to one of the plurality of intermediate shafts and having a belt engaging periphery;

a drive shaft having a plurality of belt engaging portions, the belt engaging portions being aligned with the intermediate wheels;

drive means for rotating the drive shaft; and a plurality of timing belts, each timing belt drivingly coupling one of the intermediate wheels to one of the plurality of belt engaging peripheries of the drive shaft.

2. The drive system of claim 1 wherein each driven wheel includes a load arm extending radially outwardly from the axis of rotation of the driven wheel and a counterbalance portion disposed generally opposite the load arm, said load arm being rotatably coupled to the second end of one of the plurality of connecting rods.

3. The drive system of claim 2 further including a closure defining an interior region, the drive shaft, driven wheels, intermediate wheels, timing belt and connecting rods being disposed within the interior region.

4. The drive system of claim 1 wherein the drive shaft is aligned between and parallel to the axes of rotation of the driven wheels.

5. A flitch table drive system comprising:

a flitch table support;

a plurality of intermediate shafts rotatably coupled to the flitch table support;

a plurality of driven wheels coupled to the intermediate shafts and to connecting rods that are rotatably coupled to the flitch table for reciprocating the flitch table in response to rotation of the driven wheels; and drive means for synchronously rotating the plurality of intermediate shafts by a timing belt for engaging the intermediate shafts.

6. The drive system of claim 5 wherein each driven wheel includes a counterbalance portion extending from the driven wheel generally diametrically opposite the point of connection between the driven wheel and the connecting rod.

7. The drive system of claim 5 including a drive shaft having a longitudinal axis wherein the drive shaft lies between, and in a plane with, the axes of rotation of the intermediate shafts.

8. A veneer slicer comprising:

a slicing blade;

a reciprocating flitch table for retaining a flitch for slicing;

a carriage for moving the slicing blade between a cutting position and a retracted position relative to the flitch;

a fitch support assembly for supporting the flitch table; and a flitch drive assembly for reciprocating the flitch table, the drive assembly including a plurality of timing belts coupling a drive shaft to a plurality of intermediate wheels for synchronous rotation, each intermediate wheel being coupled with and driving an intermediate shaft which drives a driven wheel which is connected to the flitch table by a connecting rod, the flitch table reciprocating in response to rotation of the driven wheels.

9. A veneer slicer comprising:

a slicing blade;

a reciprocating flitch table for retaining a flitch for slicing;

a carriage for moving the slicing blade between a cutting position and a retracted position relative to the flitch;

a flitch support assembly for supporting the flitch table; and a fitch drive assembly for reciprocating the flitch table, a drive assembly including a timing belt rotatably coupling a drive motor output shaft to at least one driven wheel, the driven wheel being connected to the flitch table by a connecting rod rotating synchronously with the timing belt, the flitch table reciprocating in response to rotation of the driven wheel.

10. The veneer slicer of claim 9 wherein the drive assembly includes a plurality of driven wheels and the timing belt couples the plurality of driven wheels to the output shaft.

11. The veneer slicer of claim 9 wherein the timing belt includes a plurality of timing belts, each driven wheel being coupled to the output shaft by one of the plurality of timing belts.

12. The veneer slicer of claim 11 further including a plurality of intermediate wheels and a drive shaft having a plurality of timing belt engaging portions, wherein each of the plurality of timing belts couples for synchronous rotation one of the plurality of intermediate wheels to one of the plurality of timing belt engaging portions.

13. The veneer slicer of claim 9 wherein the driven assembly further includes a plurality of intermediate shafts for rotatably coupling a plurality of intermediate wheels with the drive motor output shaft.

14. The veneer slicer of claim 13 wherein the timing belt includes a plurality of timing belts coupling for rotation the intermediate wheels to the motor output shaft.

15. The veneer slicer of claim 14 further including a drive shaft rotatably coupled to the motor output shaft, the timing belts coupling the output shaft for rotation, and the timing belts coupling for rotation the intermediate wheels to the drive shaft.

16. A veneer slicer comprising:

a slicing blade;

a reciprocating flitch table for retaining a flitch for slicing;

a carriage for moving the slicing blade between a cutting position and a retracted position relative to the flitch;

a flitch support assembly for supporting the flitch table; and a flitch drive assembly for reciprocating the flitch table, the drive assembly including a sacrificial toothed-belt member for limiting damage to the slicer by intentionally and preferentially absorbing damage to the veneer slicer wherein the sacrificial member includes a timing belt coupling a drive motor to a driven wheel, the driven wheel being coupled to the flitch table to reciprocate the flitch table.

* * * * *